US010619449B2

(12) United States Patent
Mebratu

(10) Patent No.: US 10,619,449 B2
(45) Date of Patent: Apr. 14, 2020

(54) SYSTEM AND METHOD FOR CONTROLLING PLACEMENT OF A FLOWABLE MATERIAL IN A WELL WITH A LOW FORMATION PRESSURE

(71) Applicant: Smartcoil Solution AS, Stavanger (NO)

(72) Inventor: Mikias Amare Mebratu, Stavanger (NO)

(73) Assignee: Smartcoil Solution AS, Stavanger (NO)

( * ) Notice: Subject to any disclaimer, the term of this patent is extended or adjusted under 35 U.S.C. 154(b) by 0 days.

(21) Appl. No.: 15/549,208

(22) PCT Filed: Feb. 25, 2016

(86) PCT No.: PCT/NO2016/000008
§ 371 (c)(1),
(2) Date: Aug. 7, 2017

(87) PCT Pub. No.: WO2016/137329
PCT Pub. Date: Sep. 1, 2016

(65) Prior Publication Data

US 2018/0023369 A1 Jan. 25, 2018

(30) Foreign Application Priority Data

Feb. 26, 2015 (NO) ..... 20150269

(51) Int. Cl.
*E21B 34/10* (2006.01)
*E21B 23/06* (2006.01)
(Continued)

(52) U.S. Cl.
CPC ..... *E21B 34/10* (2013.01); *E21B 33/12* (2013.01); *E21B 33/14* (2013.01); *E21B 34/08* (2013.01); *E21B 33/13* (2013.01); *E21B 37/06* (2013.01)

(58) Field of Classification Search
CPC ..... E21B 43/12
See application file for complete search history.

(56) References Cited

U.S. PATENT DOCUMENTS 3,378,078 A * 4/1968 Current ..... E21B 23/06 166/124
3,548,936 A 12/1970 Kilgore et al.
(Continued)

FOREIGN PATENT DOCUMENTS

EP 0159900 10/1985
EP 0183482 6/1986
(Continued)

OTHER PUBLICATIONS

Norwegian Search Report, Norwegian Patent Application No. 20150269, dated Sep. 24, 2015.
(Continued)

*Primary Examiner* — William D Hutton, Jr.
*Assistant Examiner* — Avi T Skaist
(74) *Attorney, Agent, or Firm* — Andrus Intellectual Property Law, LLP

(57) ABSTRACT

A system includes a valve and a packer for controlling a location of a fluid in a low pressure well. The valve includes a valve housing and a pressure activated valve body that is axially movable in the valve housing between a closed position and at least a partly open position. The valve body has a surface facing a pressurized liquid. Movement of the valve body is opposed by a resilient element, and the valve is designed to open at a specific pressure. The valve housing has at least one valve opening that is exposed for pressurized fluid when the valve body is moved to its at least partly open position. The packer is peripherally positioned at the outside of the valve housing. The system is adapted to be releasable connected to a coiled tubing or a wireline.

14 Claims, 6 Drawing Sheets

(51) Int. Cl.

| | |
|---|---|
| ***E21B 34/08*** | (2006.01) |
| ***E21B 33/14*** | (2006.01) |
| ***E21B 33/12*** | (2006.01) |
| *E21B 33/13* | (2006.01) |
| *E21B 37/06* | (2006.01) |

(56) References Cited

U.S. PATENT DOCUMENTS

| | | | | |
|---|---|---|---|---|
| 3,754,597 | A | 8/1973 | Garrett et al. | |
| 3,802,507 | A * | 4/1974 | Watson | E21B 43/12 166/154 |
| 3,884,300 | A | 5/1975 | Garrett et al. | |
| 4,063,594 | A | 12/1977 | Canterbury | |
| 4,648,457 | A | 3/1987 | Ross et al. | |
| 5,449,040 | A * | 9/1995 | Milner | E21B 23/06 166/123 |
| 2007/0295508 | A1 | 12/2007 | Collins et al. | |
| 2008/0302528 | A1 | 12/2008 | Samaroo et al. | |
| 2009/0065199 | A1 * | 3/2009 | Patel | E21B 23/03 166/250.01 |

FOREIGN PATENT DOCUMENTS

| | | |
|---|---|---|
| EP | 2636840 | 11/2013 |
| WO | 2014035369 A1 | 3/2014 |

OTHER PUBLICATIONS

International Search Report, PCT/NO2016/000008, dated May 30, 2016.

Written Opinion and Reply, PCT/NO2016/000008, dated May 30, 2017.

Written Opinion and Reply, PCT/NO2016/000008, dated Mar. 27, 2017.

International Preliminary Report on Patentability, PCT/NO2016/000008, dated May 15, 2017.

* cited by examiner

SYSTEM AND METHOD FOR CONTROLLING PLACEMENT OF A FLOWABLE MATERIAL IN A WELL WITH A LOW FORMATION PRESSURE

CROSS-REFERENCE TO RELATED APPLICATIONS

This application is the U.S. national stage application of International Application PCT/NO2016/000008, filed Feb. 25, 2016, which international application was published on, as International Publication WO 2016/137329 in the English language. The International Application claims priority of Norwegian Patent Application No. 20150269, filed Feb. 26, 2015. The international application and Norwegian application are both incorporated herein by reference, in entirety.

FIELD

This invention concerns a method for controlling the placement of a flowable material in a low pressure well, in particular a low pressure petroleum well, where a well bore extends into and communicates with a reservoir formation. The invention also includes a system for controlling the placement of treatment fluids into a well, in particular a petroleum well, with low formation pressure. In this context, low formation pressure means a formation in the ground with a lower pressure than a pressure exerted by a hydrostatic column of the fluid in the well bore extending into the formation.

BACKGROUND

Most low pressure wells are found in matured and depleted petroleum fields. Completion may be damaged or collapsed. This restricts mechanical access to the lower portion of the well. Installation of a mechanical device at the lower portion may be impossible. This is particularly common deep in the well around the production packer. Completion may also have scale sediment limiting mechanical access with such a mechanical device. Many wells have in addition restrictions by design, such as nipples and other.

The type of the lower completion may be a cased and perforated slotted liner, an open hole, gravel packed, stand alone screen or any other type.

When performing pumping operations which increase the hydrostatic pressure in low pressure wells, loss of fluid to the formation may be experienced at full hydrostatic head conditions and even at much reduced head conditions in some cases. As the formation is unable to sustain the prevailing pressure, fluid may flow into the actual formation, in an uncontrolled manner. The challenge is well known from pumping operations for well cementing, scale treatment, water shut-off, well stimulation, and other similar activities.

In a low pressure well the top of the liquid phase in the well bore can be, for example, 500 meters below the well bore's surface. Thus the well bore from surface to 500 meters below the surface is filled with gas. The gas may be a hydrocarbon gas, air or a mixture of hydrocarbon gas and air. The gas may also be an inert gas such as $N_2$. Gas is highly compressible when compared to liquid.

In such low pressure wells it is difficult to determine the location of a specific fluid stage pumped from the surface. This is because fluid in the well bore continues to flow downwards even after the pumping activity on the surface is terminated. The flow stops only when the pressure from the hydrostatic head is equal to the formation pressure. At this point, the upper section of the well may be full of highly compressible gas that makes controlled fluid displacement difficult. The specific fluid may end up anywhere in the well bore or in the formation, missing the targeted zone.

The problem is exemplified below by a cementing operation related to a Plug & Abandonment operation of a well. The example does not limit the scope of the invention.

According to prior art, a volume of cementing material is pumped into the well typically with a theoretical volume of displacement fluid above it, in order to locate the cementing material in the target zone of interest. However, in such a low pressure well, where the formation pressure is unable to sustain the hydrostatic head of the fluid column in the well, and where the resulting liquid head in the well bore at the end of the pumping operation is unknown, the cementing material can be under displaced or over displaced in an uncontrolled manner. Under such conditions, determining the required displacement fluid volume in order to displace the cementing material to a desired location is at least difficult.

Build up of scale is a problem in petroleum producing wells. Scale means any organic or non-organic deposit or any other undesired material on the production tubing or casing or in the formation. Scale may be dissolved in a suitable treatment fluid. A suitable treatment fluid may be an acid or a base. Removal of scale by treatment fluid requires a sufficient time of contact for the treatment fluid to dissolve the scale. Some of the treatment fluids used to remove scale may be aggressive or corrosive in nature. Therefore, it is not desirable to expose equipment such as wireline, valves, packers and anchors to such treatment fluids for too long.

Patent document U.S. Pat. No. 4,063,594 discloses a pressure-balanced well service valve for use in a low pressure formation. The valve is positioned at the bottom end of a tubing string, and the tubing string is provided with a packer above the valve. After the tubing string is located properly, the packer is set. Well fluid in the annulus below the packer may be circulated out upwards by opening a bypass valve in the packer and pumping treating fluid into the tubing. This displaces the well fluid up through the bypass valve into the annulus above the packer. The bypass valve in the packer is closed. The pressure on the treating fluid is continued and treating fluid is injected into a formation. After a calculated desirable amount of treating fluid has been injected into the formation, the pressure on the tubing is released and the service valve closes. After the treating fluid has been held in the formation the desired period, the treating fluid may be removed in the same manner as the well fluid as described above, by replacing the treatment fluid with another suitable fluid.

SUMMARY

The invention has for its object to remedy or to reduce at least one of the drawbacks of the prior art, or at least provide a useful alternative to prior art.

The object is achieved through features which are specified in the description below and in the claims that follow.

Treatment fluid means any fluid used for cementing or treating a well and includes cement, resins, polymers, scale treatment fluids or any other fluid intentionally introduced to the well to form a barrier or to dissolve, disintegrate or loosen some undesired material or to stimulate the well.

Displacement fluid means any fluid used for replacing gas in an oil well bore or tubing, and any fluid used for displacing another fluid in an oil well bore or tubing. Displacement fluid may be water, brine, oil, mud or any other suitable fluid.

According to the invention, a valve in a closed position is placed in a well anywhere below the top of the liquid phase. The well bore above the valve in a low pressure well may then be filled with a displacement fluid in addition to a well fluid without any loss to the formation. When a certain pressure is applied to the valve through the fluid or fluids in the well bore above the valve, the valve opens sufficiently to establish an acceptable flow rate. Said flow rate is necessary for transporting a treatment fluid such as cementing material down the well bore and through the valve.

At this point, the uncontrolled fluid loss to the formation is reduced or eliminated, the well bore is full of liquid fluids, and the treatment fluid can be displaced in a controlled manner, with a positive pressure on surface. Therefore, an established conventional technique of placing cementing material at a target zone may be utilized successfully.

The invention is not limited to cementing material. The treatment fluid may be a fluid designed to dissolve, disintegrate or loosen scale. The treatment fluid may be a fluid for lubricating equipment. The treatment fluid may be a cleaning fluid. The target zone may be above the valve. The target zone may be below the valve. The valve may be positioned within the target zone. The valve may be closed in order to let the treatment fluid react with the material at the target zone under static condition. The treatment fluid may be kept in the target zone for a desired period. After treatment, the treatment fluid may be displaced by a displacement fluid. All treatment fluid may be displaced through the valve prior to retrieving the valve.

The invention is defined by the independent patent claims. The dependent claims define advantageous embodiments of the invention.

In a first aspect the invention relates more particularly to a system comprising a valve and a packer for controlling a location of a displacement fluid or a treatment fluid in a low pressure well where a well bore extends into and communicates with a reservoir formation, said valve comprises:

a valve housing;

a pressure activated valve body that is axially movable in the valve housing between a closed position and at least a partly open position, the valve body has a surface facing a pressurized liquid, and where the movement of the valve body is opposed by a resilient element, and the valve is designed to open at a specific pressure;

the valve housing has at least one valve opening that is exposed for pressurized fluid when the valve body is moved to its at least partly open position, and such that the packer is peripherally positioned at the outside of the valve housing, and the system is adapted to be releasable connected to a string, said string consisting of a coiled tubing or a wireline. The low pressure well may be a low pressure petroleum well.

The resilient element may be a spring. Other resilient members such as a gas spring may in some cases be useful. In some cases the valve body may be moved by an actuator.

The system (100) may further comprise an anchor positioned at the outside of the valve housing. In the position of use the anchor may be positioned below the packer.

In a second aspect the invention relates more particularly to a method for controlling the location of a treatment fluid in a low pressure well where a well bore extends into and communicates with a reservoir formation wherein the method includes:

lowering a system as described above at a desired depth in the well bore by a string, said string consisting of a coiled tubing or a wireline;

filling a space above the valve in sequence with a displacement fluid, a treatment fluid and a displacement fluid;

increasing fluid pressure in the space to open the valve and achieve a desired fluid flow rate through the valve at a reduced pressure downstream the valve;

pumping a fluid through the valve until the treatment fluid is displaced to a target zone, said fluid comprising a well fluid, the displacement fluid or the treatment fluid.

The low pressure well may be a low pressure petroleum well. The well bore may be cased or open. The setting operation of a tool in a well bore is well known by a skilled person and is not explained here.

Normally a displacement fluid is pumped behind the treatment fluid to locate the treatment fluid at the target zone.

The method may include reducing the fluid pressure in the space above the valve for the valve to close.

The method may further include to displace the treatment fluid completely further through the valve with displacement fluid when the target zone is at least partly above the valve.

The method may include retrieving the system with a string after the work operation, by lowering the string in the displacement fluid in the space above the system. The displacement fluid may be a non-aggressive fluid. The string may be a coiled tubing or a wireline.

The treatment fluid may be a cement. The valve may be closed in order to let the cement cure at its target zone.

The treatment fluid may be a scale dissolving fluid or a fluid designed for disintegrating scale or for loosening scale. The treatment fluid may be a lubricating fluid. The treatment fluid may further be a cleaning fluid.

The method and system according to the invention provides a relatively simple and reliable solution for a long felt problem, particularly related to cementing operations and removal of scale.

Pumping operations covers any pumping activity, such as pumping for cementing, stimulation, or any other well treatment operations. Pumping can also be performed to increase the well pressure. More particularly, water may be pumped into the well bore to increase the pressure above the valve, in order to open it. Then cement may be pumped, followed by water or brine or any other fluid, until the cement is displaced through the valve and spotted at the target zone.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
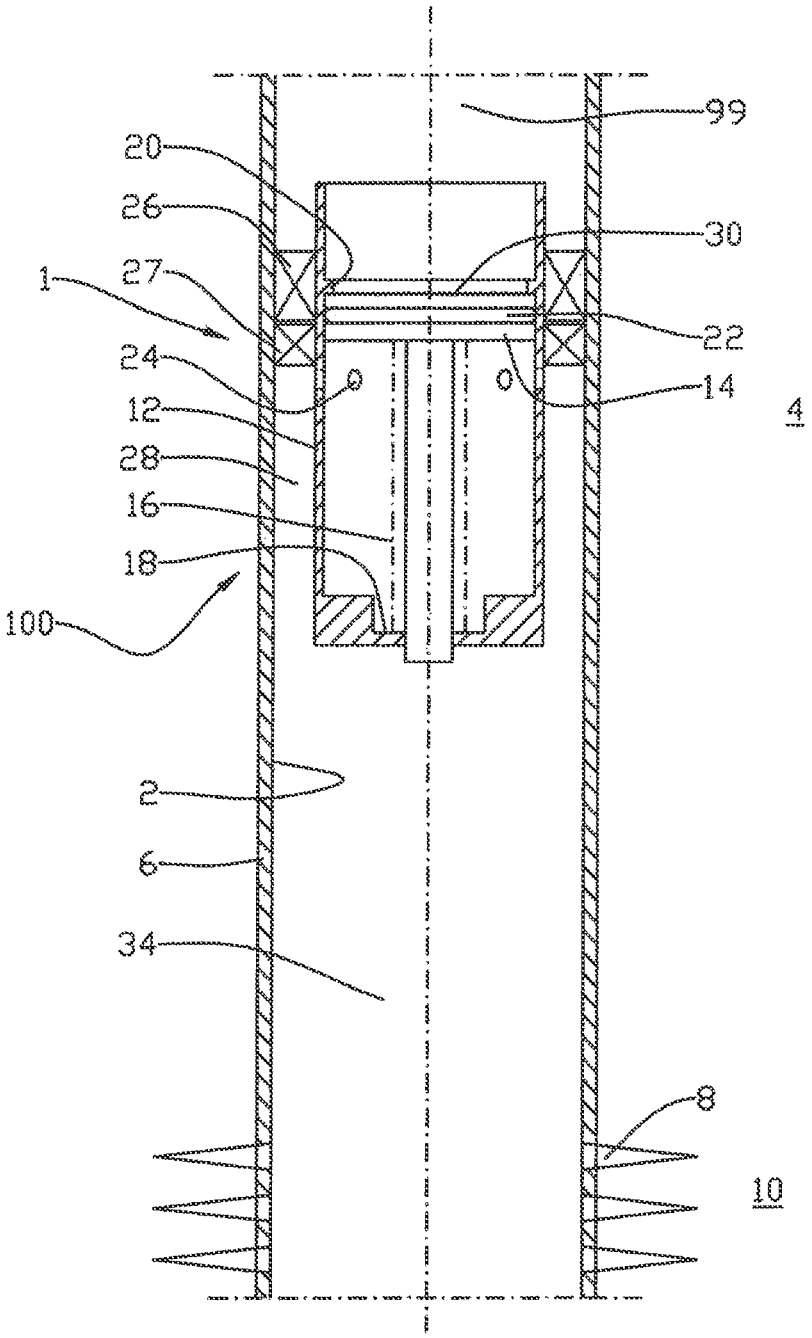
FIG. 1 shows schematically a system according to the invention, where the system is positioned within a casing and where a valve body of a valve is in its closed position.

On the drawings the reference numeral 100 denotes a system comprising a valve 1 and a packer 26 that is positioned in a well bore 2 in a ground 4. In this embodiment the well bore 2 has a casing 6 that has perforations 8, thus communicating with a reservoir formation 10.

The valve 1 has a cylindrical valve housing 12 that on its inside has an axially movable piston formed valve body 14. A resilient element 16, here in the form of a spring, that extends between the valve body 14 and an abutment 18 in the valve housing 12, is biasing the valve body 14 towards its closed position. In its closed position the valve body 14 abuts a stopper 20 as shown in FIG. 1. The valve body 14 preferably has a seal 22 against the valve housing 12.

The valve housing 12 has a number of valve openings 24 spaced apart at an axial position behind the valve body 14 when the valve body 14 is in its closed position.

The valve housing 12 is adapted to be temporary connected to a string 5. The string 5 may be a wireline as known in the art. In an alternative embodiment the string 5 may be a coiled tubing as known in the art.

The packer 26 is positioned in a first annulus 28 between the valve 1 and the casing 6, fixing the valve 1 at least temporary to the casing 6. An optional anchor 27 is positioned in the annulus 28 to further fix the valve 1 to the casing 6. The packer 26 may be releasable. The anchor 27 may be retractable. The packer 26 and the optional anchor 27 are operated through the string 5. When the valve 1 is positioned and fixed at the desired depth in the well bore 2, the string 5 is released and the string 5 is withdrawn to a surface (not shown).

Figure 2:
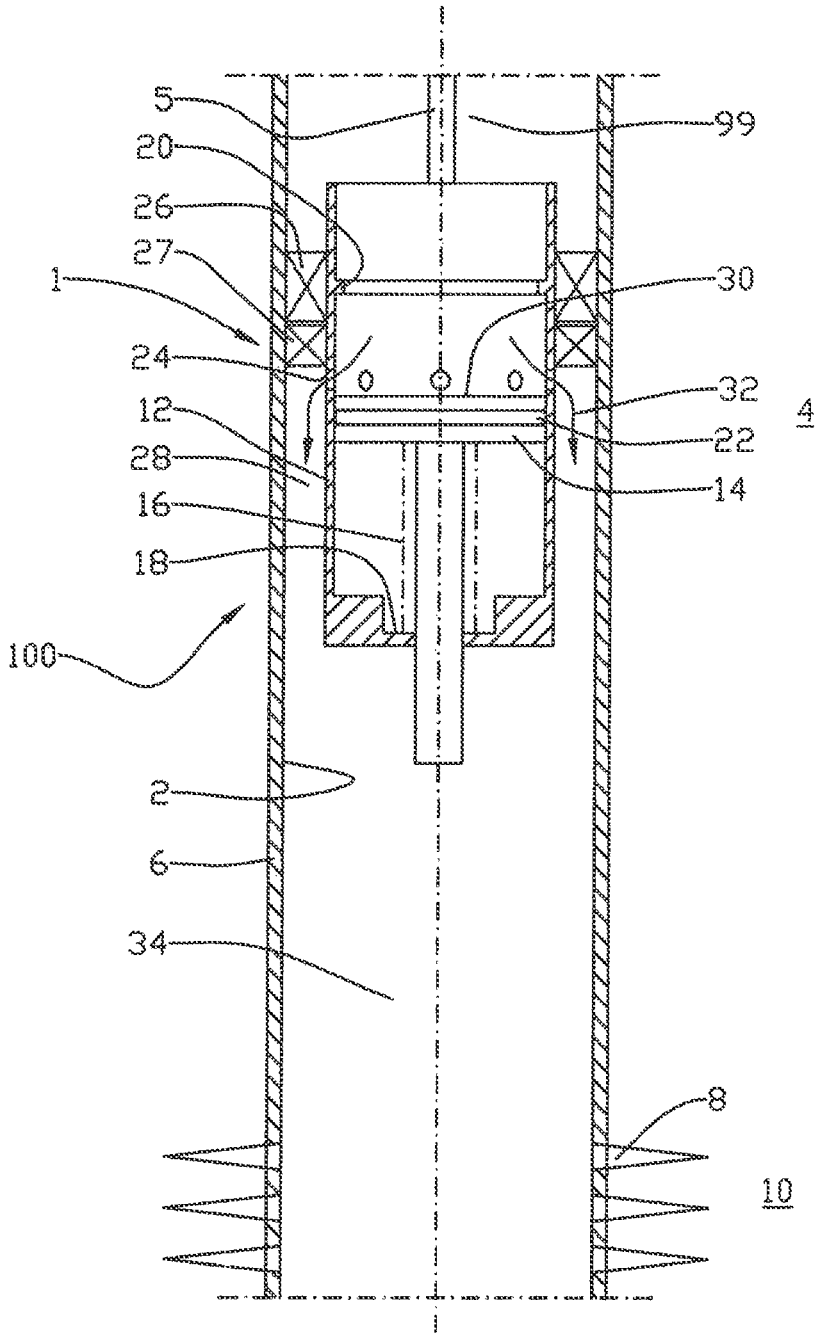
FIG. 2 shows the same as in FIG. 1, but with the valve body in an open position.

The head of a fluid column (see FIG. 3) in a space 99 above the valve 1, is acting on a surface 30 of the valve body 14. When the force on the surface 30 exceeds a force the resilient element 16 is designed to sustain, the valve body 14 moves in the valve housing 12 to an open position where the valve openings 24 are at least partly exposed to the fluid above the valve body 14. A flow is established through the valve 1 as indicated by arrows 32 in FIG. 2.

When the valve 1 opens, there is a pressure loss across the valve 1 that reduces the pressure in the well bore 2 below the valve 1 relatively to the pressure above the valve 1. Further, if the pressure above the valve 1 is reduced, the valve 1 closes. In the closed position the valve 1 carries the full hydrostatic head of the column in the space 99 above the valve 1. The hydrostatic head to which the reservoir formation 10 is exposed, is reduced to the distance from the reservoir formation 10 to the valve 1.

As indicated in the general part of the specification, the method according to the invention includes the steps of:

- positioning a valve 1 that is designed to open at a specific pressure, at a desired depth in the well bore 2;
- filling the well bore 2 above the valve 1 with displacement fluid;
- increasing fluid pressure in the column above the valve 1 to open the valve 1 and achieve a desired fluid flow rate through the valve 1 at a reduced pressure downstream the valve 1;
- pumping and displacing a treatment fluid down through the valve 1 until the treatment fluid is displaced to a target zone 34.

Figure 5:
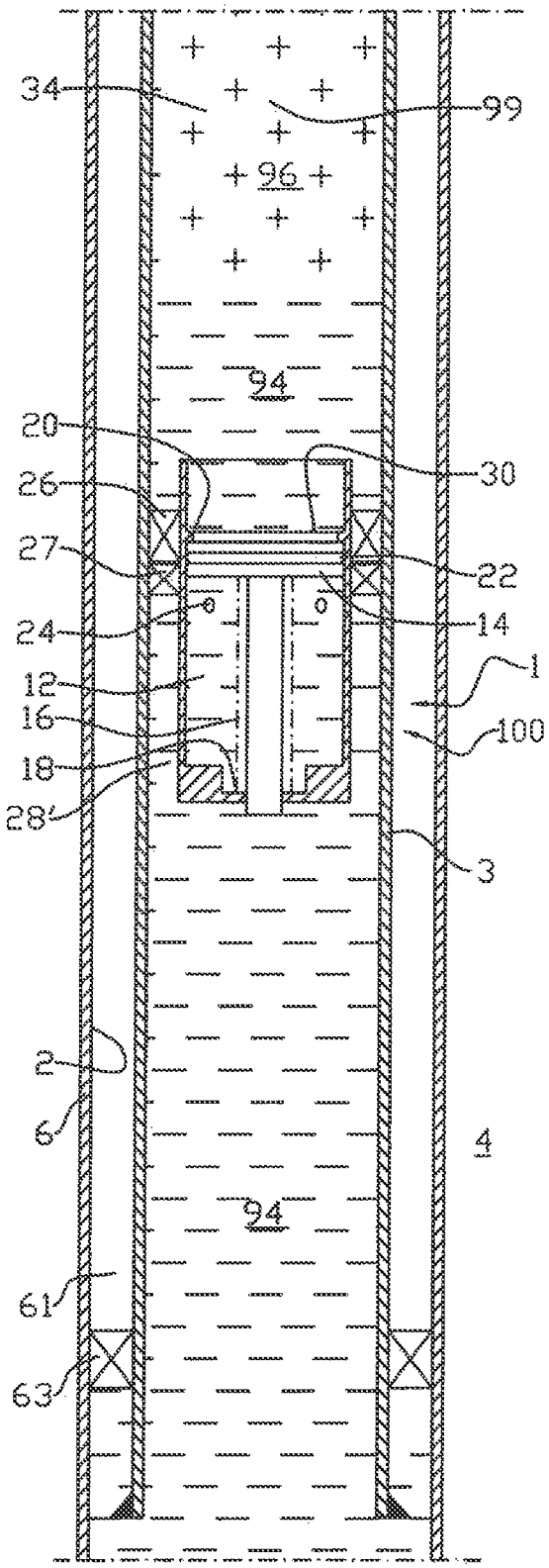
Figure 6:
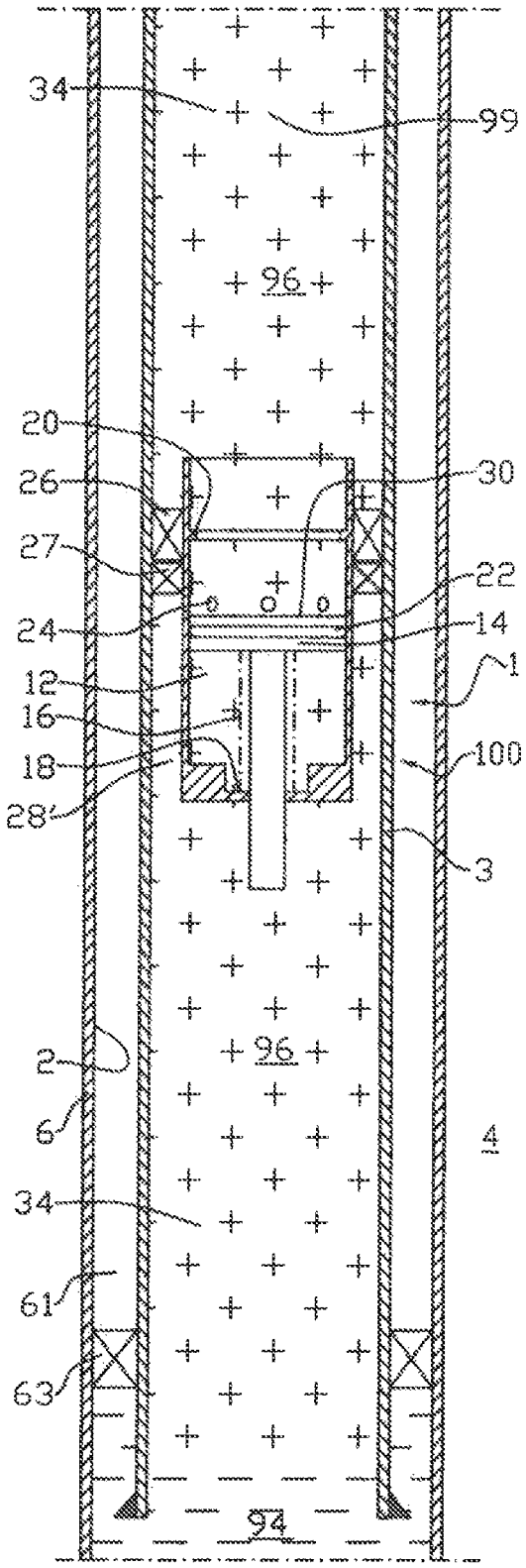
Figure 7:
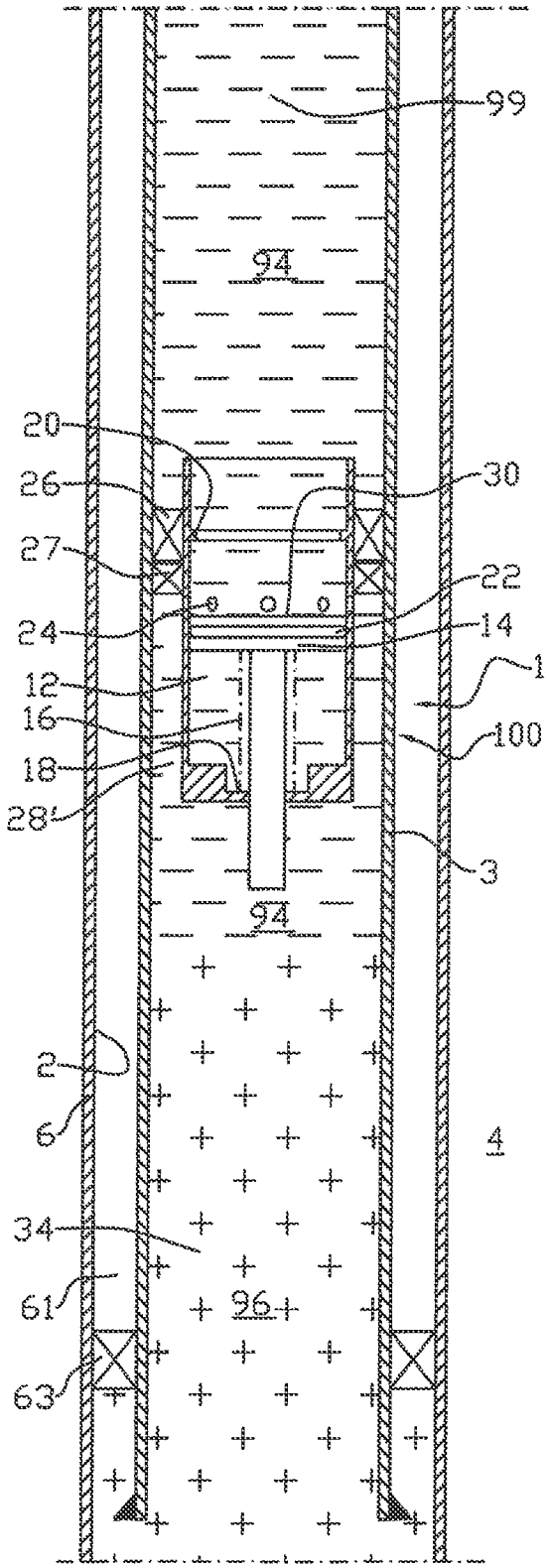
Figure 8:
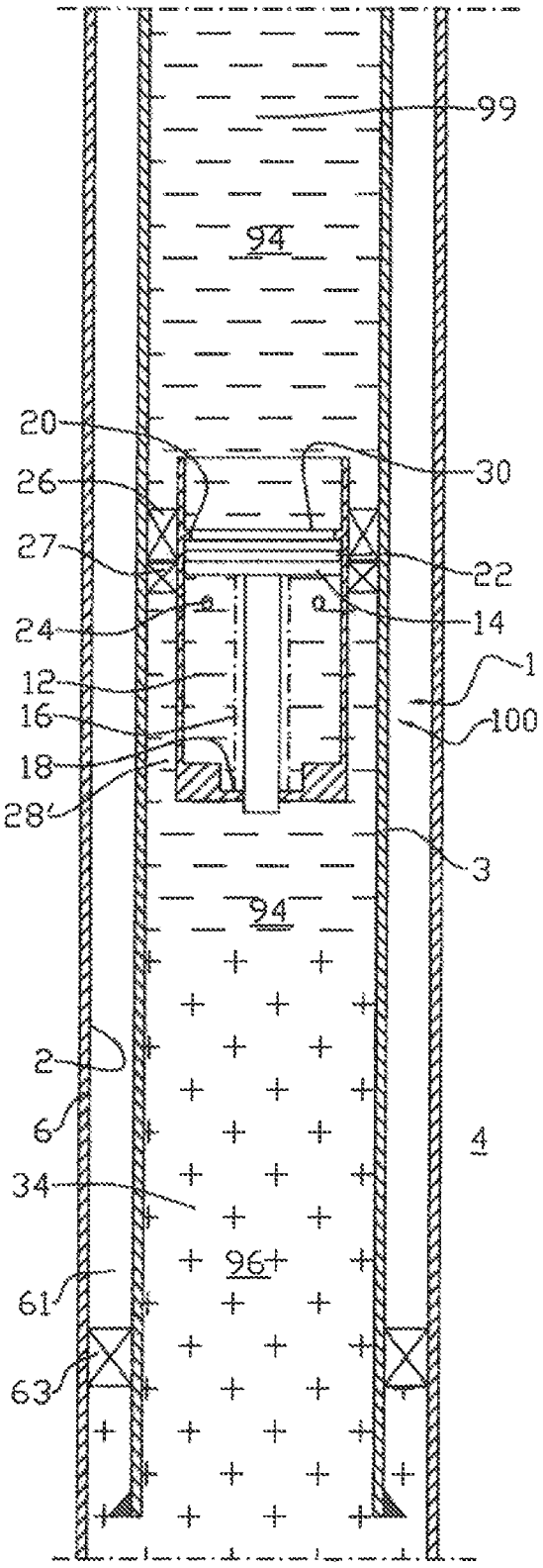
Figure 9:
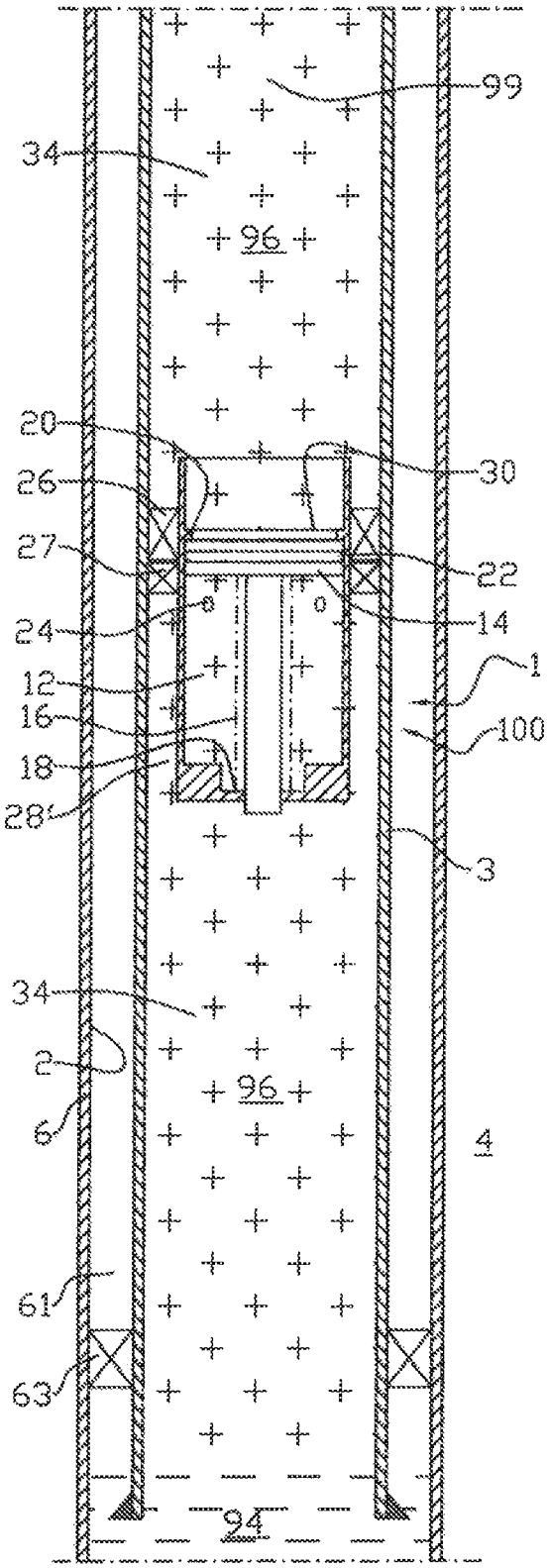

The target zone 34 may be below the valve 1 as indicated in FIGS. 1, 2, 7, 8 or the target zone 34 may be above the valve 1 as indicated in FIG. 5 or the valve 1 may be within the target zone 34 as indicated in FIGS. 6, 9. The target zone 34 may be immediately below the valve 1 or at any other position below the valve 1. The target zone 34 may be immediately above the valve 1 or at any other position above the valve 1.

As the valve 1 reduces the hydrostatic head of the well bore 2 away from the perforations 8, contrary to prior art, the loss of fluid to the reservoir formation 10 may be governed from a surface (not shown).

When the operation is completed, the valve 1 may be retrieved by lowering the string 5 down to the valve 1. The string 5 is connected to the valve housing 12 by a manner known in the art. The packer 26 and the optional anchor 27 are deactivated by operation through the string 5, and the valve 1 is retrieved to the surface by raising the string 5.

FIGS. 3-10 show the valve 1 positioned in a tubing 3 within a casing 6. An annulus 28' is formed between the valve housing 12 and the tubing 3. The packer 26 is positioned in the annulus 28', fixing the valve 1 at least temporary to the tubing 3. The optional anchor 27 is positioned in the annulus 28' to further fix the valve 1 to the tubing 6. The packer 26 may be releasable. The anchor 27 may be retractable.

A second annulus 61 is formed between the tubing 3 and the casing 6. A second packer 63 is positioned in the second annulus 61 as is known in the art.

Figure 3:
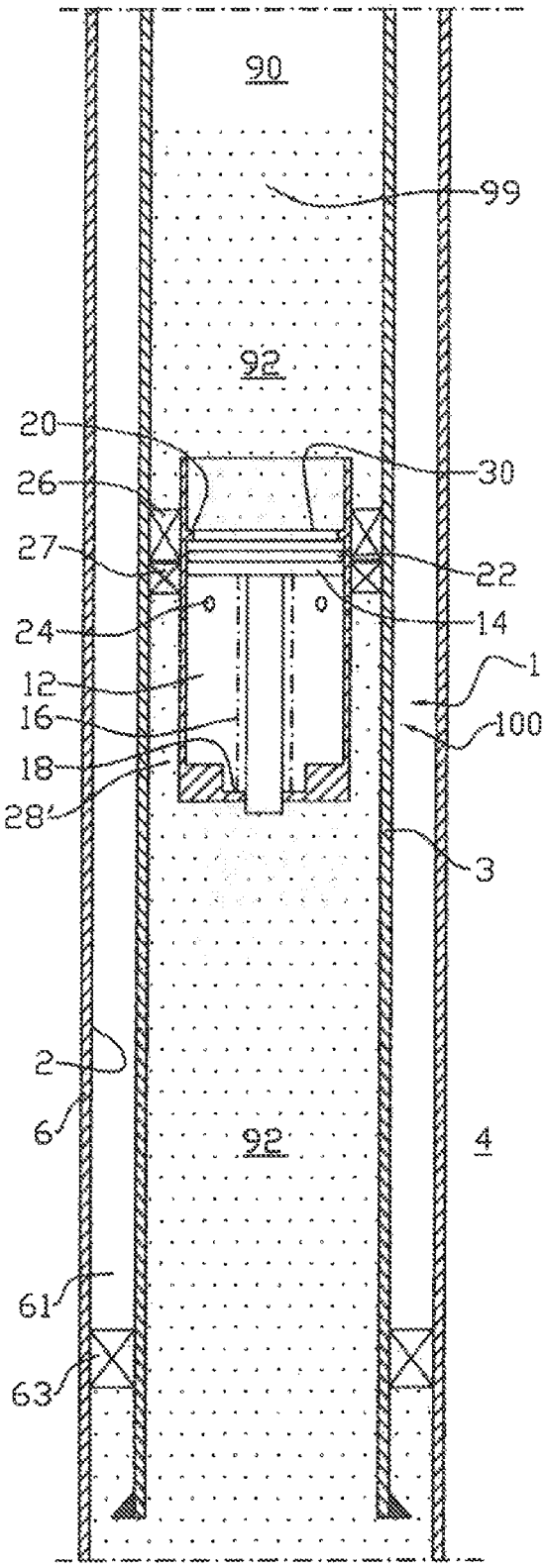
FIGS. 3-10 shows on a smaller scale the system positioned within a production tubing and with different fluids surrounding the system.

The valve 1 is run and set in the tubing 3 in the same manner as described above for setting the valve 1 in a casing 3. This is shown in FIG. 3. The valve 1 is set in a low pressure well where a gas phase 90 is extending to the surface of the well above a well fluid 92.

Treatment of Lower Section of Well and Formation

Figure 4:
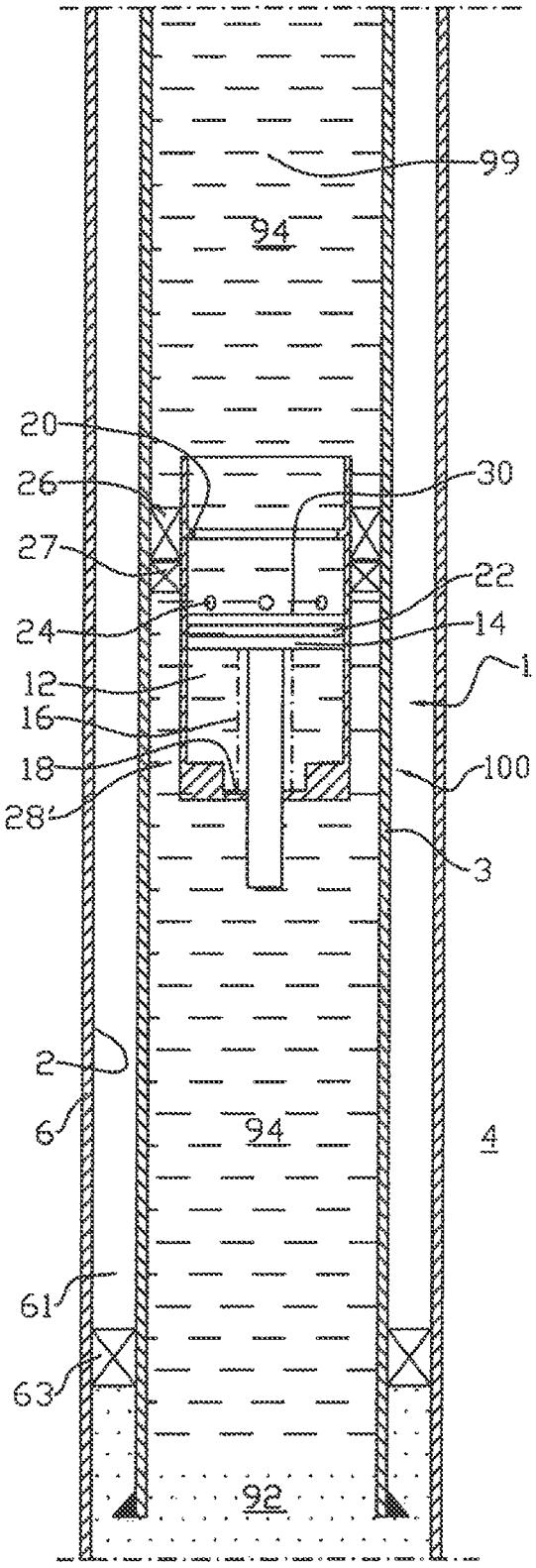

The valve 1 is run and set anywhere in the tubing 3 below the top of the well fluid 92 as shown in FIG. 3. A brine 94 or other suitable fluid such as water, is pumped into the tubing 3 until the tubing 3 is full of liquid. The pressure on the surface 30 displaces the valve body 14 within the valve housing 12 as described previously and a flow is established through the valve 1 as indicated by arrows 32 in FIG. 2. Pumping of brine 94 or other suitable liquid continues until there is brine 94 above and below the valve 1 as shown in FIG. 4. As the well is a low pressure well, the well fluid 92 is injected into the formation 4. The packers 27 and 63 are barriers such that the well fluid 92 cannot flow upwards in the annulus 61 or bypass the valve 1.

Thereafter a treatment fluid 96 is pumped into the tubing 3. The treatment fluid 96 displaces the brine 94 or other suitable fluid as shown in FIG. 6. The brine 94 is injected into the formation 4. When, by calculation, a sufficient amount of treatment fluid 96 has entered the tubing 3, brine 94 or other suitable fluid displaces the treatment fluid 96 until the contact surface between the brine 94 and the treatment fluid 96 is below the valve 1 as shown in FIG. 7. Pumping is terminated and the pressure on the valve surface 30 is thereafter reduced such that the valve 1 closes, as shown in FIG. 8. The treatment fluid 96 will thereafter react with scale (not shown) in the lower part of the tubing 3, or in the well below the tubing 3 or both. The valve 1 resists pressure above the valve 1. The packer 63 resists the hydrostatic head above the packer 63 in the annulus 61. Thereby the treatment fluid 96 will be stagnant in a low pressure well and there is sufficient time for the treatment fluid 96 to dissolve or disintegrate the scale.

The valve 1 is positioned in the brine 94 and is not exposed to the aggressive treatment fluid 96 for a prolonged time. The string 5 is lowered in brine 94. This is particularly beneficial when the string 5 constitutes a wireline which is vulnerable for exposure to an aggressive treatment fluid 96. The valve 1 is retrieved to the surface, and the well is produced.

Treatment of Production Tubing 3

The valve 1 is run and set anywhere in the tubing 3 below the surface of the well fluid 92 as shown in FIG. 3. A brine 94 or other suitable fluid such as water, is pumped into the tubing 3 until the tubing 3 is full of liquid. The pressure on the surface 30 displaces the valve body 14 within the valve housing 12 as described previously and a flow is established through the valve 1 as indicated by arrows 32 in FIG. 2. Pumping of brine 94 or other suitable liquid continues until there is brine 94 above and below the valve 1 as shown in FIG. 4. As the well is a low pressure well, the well fluid 92 is injected into the formation 4. The packers 27 and 63 are barriers such that the well fluid 92 cannot flow upwards in the annulus 61 or bypass the valve 1.

Thereafter a treatment fluid 96 is pumped into the tubing 3. The treatment fluid 96 displaces the brine 94 or other suitable fluid as shown in FIG. 6. The brine 94 is injected into the formation 4. When, by calculation, a sufficient amount of treatment fluid 96 has entered the tubing 3, brine 94 or other suitable fluid displaces the treatment fluid 96 until the treatment fluid 96 covers the portion of the tubing 3 to be treated. The portion of the tubing 3 to be treated may be above the valve 1, as shown in FIG. 5, or both above and below the valve 1 as shown in FIGS. 6 and 9, or below the valve 1 as shown in FIG. 8. Pumping is terminated and the pressure on the valve surface 30 is thereafter reduced such that the valve 1 closes, as shown in FIGS. 5, 8 and 9. The treatment fluid 96 will thereafter react with scale (not shown) in the portion of the tubing 3 above the valve 1 and in the portion of the tubing 3 below the valve 1 if that is intended. The valve 1 resists the pressure above the valve 1. The packer 63 resists the pressure above the packer 63 in the annulus 61. Thereby the treatment fluid 96 will be stagnant above the valve 1 and below the valve 1 in a low pressure well and there is sufficient time for the treatment fluid 96 to dissolve, disintegrate or loosen the scale.

Figure 10:
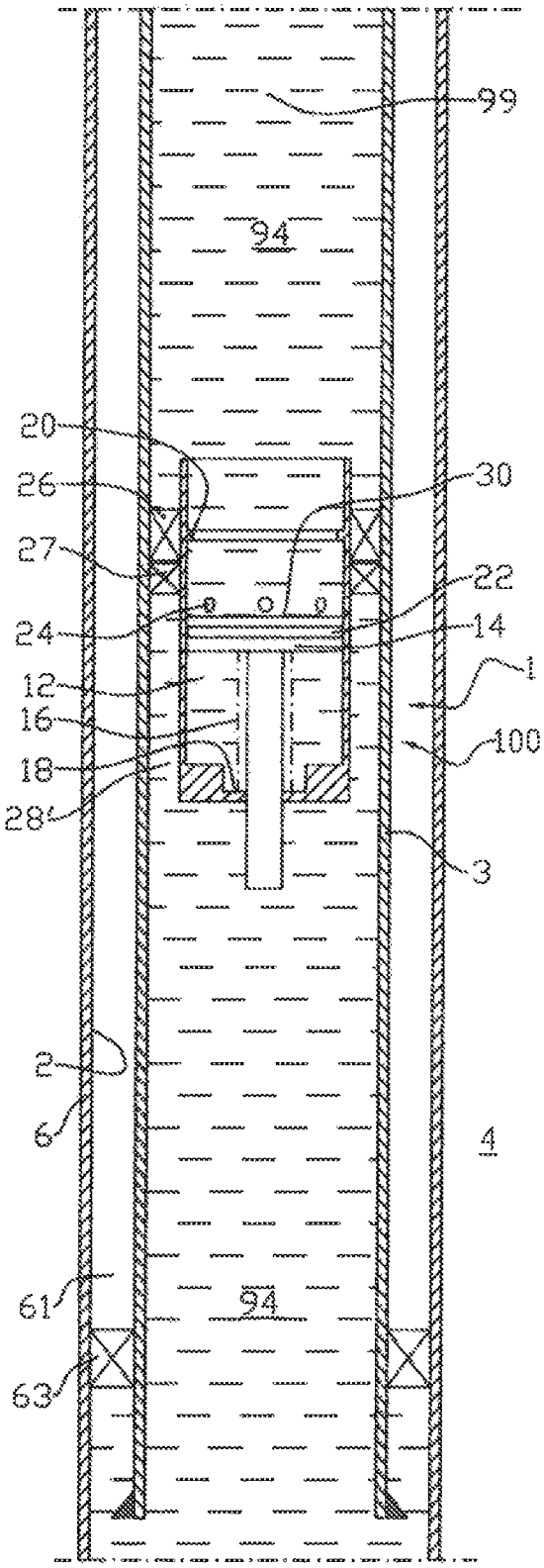

When treatment is completed, the treatment fluid 96 is displaced by more brine 94 as shown in FIGS. 7 and 10. As the well is a low pressure well, the treatment fluid 96 is injected into the formation 4. The valve 1 is retrieved as described previously by the string 5.

By this procedure the treatment fluid 96 is positioned in a controlled manner in the tubing 3 in a low pressure well. The treatment fluid 96 stays in contact with the scale for the required amount of time. Treatment fluid 96 may be displaced downwards at any time. Thereby parts of the tubing (3) and equipment are not exposed to an aggressive treatment fluid 96 for longer than necessary. The valve 1 may be retrieved by a string 5 such as a wireline, without exposing the string 5 to an aggressive treatment fluid 96.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A system comprising:

a valve and a packer for controlling a location of a displacement fluid or a treatment fluid in a well bore that extends into and communicates with a reservoir formation, wherein a top of a well bore fluid in the well bore is below a surface of the well bore, wherein the valve comprises:

a valve housing;

a pressure activated valve body that is axially movable in the valve housing between a closed position and at least a partly open position, the valve body having a surface facing at least one of the displacement fluid and the treatment fluid in a space under pressure from above the valve body, wherein the space is laterally limited by a casing or a tubing, wherein movement of the valve body is opposed by a resilient element, and wherein the valve is configured to open at a specific pressure;

wherein the valve housing has at least one valve opening that is exposed to the at least one of the displacement fluid and the treatment fluid under pressure when the valve body is moved to its at least partly open position;

wherein the packer is peripherally positioned at the outside of the valve housing and adapted to at least temporarily fix the valve housing to the casing or the tubing;

wherein the packer is operable by a wireline and forms a barrier such that the at least one of the displacement fluid and the treatment fluid cannot flow upwards and bypass the packer and the valve housing; and wherein the system is configured to be releasable from the wireline anywhere within the well bore below the top of the well bore fluid therein.

2. The system according to claim 1, wherein the resilient element is a spring.

3. The system according to claim 1, where the system further comprises an anchor positioned at the outside of the valve housing.

4. A method for controlling a location of a treatment fluid in well bore that extends into and communicates with a reservoir formation, the method comprising:

providing a system comprising a valve and a packer for controlling a location of a displacement fluid or a treatment fluid in the well where a well bore extends into and communicates with a reservoir formation, wherein the valve comprises a valve housing; a pressure activated valve body that is axially movable in the valve housing between a closed position and at least a partly open position, the valve body having a surface facing at least one of the displacement fluid and the treatment fluid under pressure from above the valve body, wherein movement of the valve body is opposed by a resilient element, and wherein the valve is configured to open at a specific pressure; the valve housing having at least one valve opening that is exposed to the at least one of the displacement fluid and the treatment fluid under pressure when the valve body is moved to the at least partly open position; wherein the packer is peripherally positioned at the outside of the valve housing, the packer is operable by a wireline and forms a barrier such that fluid cannot flow upwards and bypass the packer and the valve housing, and the system is configured to be releasable from the wireline anywhere within the well bore below a top of a well bore fluid therein;

lowering the system at a desired depth in the well bore by the wireline, wherein the top of the well bore fluid in the well bore is below the surface of the well bore;

fixing the packer in an annulus between the valve housing and a tubing;

releasing the wireline from the system within the well bore and withdrawing the wireline to a surface above the well bore in which the top of the well bore fluid in the well bore is below the surface of the well bore;

filling a space above the valve in sequence with a displacement fluid, a treatment fluid and an additional displacement fluid, wherein the space is defined between the tubing and the valve;

increasing a fluid pressure in the space to open the valve and achieve a desired fluid flow rate through the valve at a reduced pressure downstream the valve;

pumping a fluid through the valve until the treatment fluid is displaced to a target zone, the fluid comprising a well fluid, the displacement fluid or the treatment fluid; and injecting the well fluid into a formation.

5. The method according to claim 4, further comprising lowering the system such that the system optionally is positioned above the target zone, within the target zone or below the target zone.

6. The method according to claim 5, further comprising reducing the fluid pressure in the space above the valve for the valve to close.

7. The method according to claim 4, further comprising displacing the treatment fluid completely further through the valve with at least one of the displacement fluid and the additional displacement fluid when the target zone is at least partly above the valve.

8. The method according to claim 4, further comprising retrieving the system with a wireline, by lowering the wireline in the displacement fluid in the space above the system.

9. The method according to claim 5, wherein the treatment fluid is a cement.

10. The method according to claim 5, wherein the treatment fluid is a scale dissolving fluid.

11. The method according to claim 4, wherein the surface of the valve body is higher within the well bore than the at least one valve opening in the valve housing when the valve body is in the closed position.

12. The system according to claim 1, wherein the packer is peripherally positioned at an open top of the valve housing which is continuously exposed to the well bore.

13. The method according to claim 4, wherein the packer is peripherally positioned at an open top of the valve housing which is continuously exposed to the well bore.

14. The system according to claim 1, wherein the surface of the valve body is higher within the well bore than the at least one valve opening in the valve housing when the valve body is in the closed position.

* * * * *